United States Patent [19]

Bieneman

[11] Patent Number: 4,554,538

[45] Date of Patent: Nov. 19, 1985

[54] MULTI-LEVEL RASTER SCAN DISPLAY SYSTEM

[75] Inventor: Matthew J. Bieneman, Middle River, Md.

[73] Assignee: Westinghouse Electric Corp., Pittsburgh, Pa.

[21] Appl. No.: 498,212

[22] Filed: May 25, 1983

[51] Int. Cl.[4] ..... G09G 1/00

[52] U.S. Cl. ..... 340/799; 340/721; 340/744; 340/747; 340/703

[58] Field of Search ..... 340/721, 723, 724, 744, 340/745, 747, 798, 799, 703

[56] References Cited

U.S. PATENT DOCUMENTS

| | | | |
|---|---|---|---|
| 3,976,982 | 8/1976 | Eiselen | 340/723 |
| 4,103,331 | 7/1978 | Thacker | 340/799 |
| 4,125,873 | 11/1978 | Chesarek | 340/799 |
| 4,197,590 | 4/1980 | Sukonick et al. | 340/721 |

*Primary Examiner*—Gerald L. Brigance
*Attorney, Agent, or Firm*—J. B. Hinson

[57] ABSTRACT

A raster scan display system for overlapping images. A non-interfering erasure and relocation capability is included by providing a multi-level digital signal specifying the status of each pixel of the display and the number of display images which overlap at each pixel. For each image to be displayed the associated stored digital word is incremented one count. For each image to be erased the associated stored digital word is decremented one count. An image or a portion of an image is relocated by decrementing the data word associated with the current location and incrementing the data word associated with the new location. Expanding the data storage permits the same technique to be applied to multi-color display systems.

6 Claims, 6 Drawing Figures

MULTI-LEVEL RASTER SCAN DISPLAY SYSTEM

BACKGROUND OF THE INVENTION

1. Field of the Invention:

The invention relates to display systems and more specifically to raster scan display systems providing means for the relocation of overlapping elements without interference.

2. Description of the Prior Art:

In typical prior art raster scan systems displayed images were relocated by deleting (erasing) the image to be relocated and redrawing (writing) the image to be relocated at the new location. If the deleted portions overlapped one or more other images, all these images were erased. This was due to the fact that the raster scan system itself did not contain any capability of indicating the number of overlapping images which were being displayed at a particular position in the final display. Generally, these systems were associated with a computer which, through the use of software routines, kept track of the number of overlapping display images so that after a particular image was deleted during a relocation operation the images which were erased but not relocated could be restored. Such an arrangement had the disadvantages of being both relatively complicated from a software standpoint with image relocation being relatively slow. These problems are substantially reduced by the display system which is the subject of this invention.

SUMMARY OF THE INVENTION

The system which is the subject of this invention comprises a raster scan display system permitting overlapping images to be relocated without requiring the computer to restore portions of the images which were not relocated. Each scan line of the display utilized by the system is divided into pixels with each pixel either being dark or illuminated depending upon the images being displayed. An addressable multiple storage location digital memory is utilized to store digital signals (multi-bit digital words) which are synchronously read with the raster scan signals to generate a video signal which drives the display screen. Each of the multi-bit digital words includes sufficient bits to permit the digital word to be incremented one count for each overlapping level of displayed images. An element of an image to be displayed is drawn, erased or moved by selectively incrementing or decrementing the appropriate memory location, or locations.

DESCRIPTION OF THE PREFERRED EMBODIMENT

Figure 1:
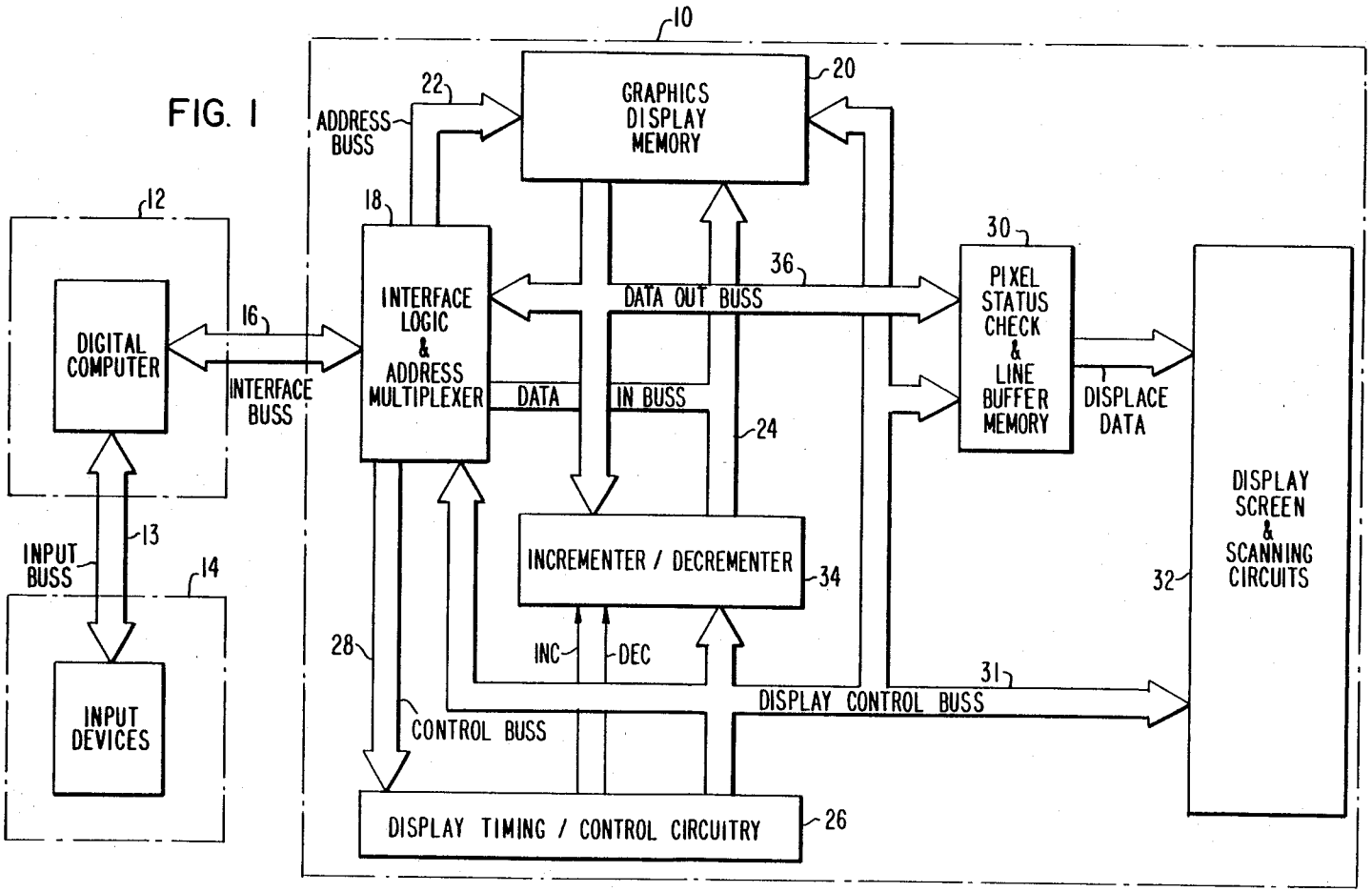
FIG. 1 is a block diagram of the invention.

The system comprises a display unit 10, a general purpose digital computer 12 and suitable input/output devices 14. In practice the input/output device 14 can be any suitable prior-art device such as a keyboard. Input device 14 is coupled to the general purpose digital computer 12 via the input bus 13, in a conventional manner. A conventional computer interface bus 16 couples the digital computer 12 to the display system 10 providing the digital computer 12 means to communicate with the display system 10 for purposes of modifying the visual display (displayed images) and controlling the display system 10.

Digital display system 10 includes interface logic and address multiplexer unit 18 which is coupled directly to the digital computer 12 through the interface bus 16. As is conventional, the interface logic and address multiplexer 18 receives both logic and control signals via the interface bus 16. In response to these signals the logic interface and address multiplexer unit 18 generates address and control signals. The address signals are coupled via address bus 22 to a graphics display memory 20 to identify storage locations. The control signals are coupled to display timing and control logic 20 via control bus 28. The combination of the computer-generated addresses and control signals provides the computer 12 with access to the display graphics memory 20 for the purpose of reading and writing. All images can be erased by the computer 12 writing appropriate data in all storage locations of the graphics display memory 20.

To initiate the display of an image, the digital computer 12 transfers data (writes) representing the desired image into the proper storage locations of the graphics display memory 20. In the displayed image, each scan line comprises a plurality of pixels (the number selected to give the desired resolution) with each pixel of the final video signal determined by the digital signal stored in a storage location in the graphics display memory 20 associated therewith. A data word having a value of zero, and not zero, respectively, indicate that the associated pixel in the displayed image will have a first illumination level (DARK) and a second illumination level (illuminated). These illuminations levels are arbitrary and can be reversed or otherwise modified.

Following storage of the data representing the image to be displayed in the display memory 20, as described above, the digital computer 12 initiates display of the image by sending appropriate control signals to the display timing and control circuitry 26 via the control bus 28. After initiation the display timing and control circuitry 26 generates addresses which are coupled via the interface logic and address multiplexer 18 and address bus 22 to the graphic display memory 20 to sequentially read the data stored in the graphics display memory 20 to provide data for generating sequential lines of video data representing the image or images to be displayed.

The digital data words stored in the graphics display memory 20 comprise a stored data matrix with the individual words being associated with the individual pixels of the displayed image. As the data words are read from the graphics display memory 20 they are coupled via the data output bus 36 to pixel status check and line buffer memory 30. Pixel status check and line buffer 30 includes storage for at least one line of video data permitting the computer 12 to have access to the graphics display memory 20 without interfering with the line of video being displayed. Display and timing control circuitry 26 generates timing signals which are coupled to the display screen and scanning circuits 32 as well as the graphic display memory 20 and the incrementer/decrementer circuit 34 to properly synchronize the system.

Figure 2:
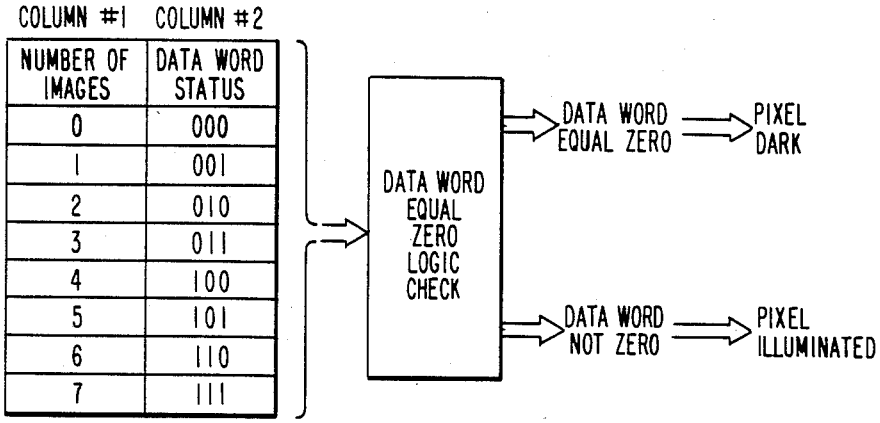
FIG. 2 is a diagram illustrating the use of a multi-bit data word in the data matrix utilized in the system comprising the invention.

Each storage location of the graphics display memory 20 provides storage for a digital word consisting of two or more bits. FIG. 2 is a diagram illustrating the use of a three-bit data word to identify the number of images associated with each pixel of the display. Since each of the data words contain three bits it is capable of representing eight distinct binary values. A binary value of "zero" (bit pattern 000) indicates that the associated pixel is not being utilized to display an image. A binary value of "one" (bit pattern 001) indicates that only one displayed image utilizes the associated pixel. Each of the six remaining non-zero values indicates that an additional image is being displayed such that the images overlap at the point identified by the associated pixel. The number of overlapping images associated with the pixel is indicated in column #1, FIG. 2. Thus, the technique illustrated provides the capability of uniquely identifying six levels of overlapping images for each pixel, as indicated in the first column of FIG. 2.

Of course, the functions of the individual bit patterns, discussed above, are arbitrary. For example, other bit patterns could be used to indicate that the associated pixel was not being used to display an image.

Logically the technique described above is relatively easy to implement by simply coupling all bits of the data word (all possible bit patterns are illustrated in column two of FIG. 2) to a data word equal zero logic check as indicated in FIG. 2 with the data word being equal to "zero" corresponding to the associated pixel being dark with a non-zero value indicating that the pixel is illuminated. Of course, the three-bit data word illustrated in FIG. 2 is intended to be an illustration only and not a limitation. That is to say that any number of bits can be used in the data word with the number of overlapping images increasing exponentially with the number of bits.

To add an image to the display, each data word associated with a pixel to be used to display the image is read from the graphics display memory by the computer 12. Functionally this is accomplished by coupling the appropriate address and control signals to the display system via interface bus 16. Each of the data words is incremented by the digital computer 12 one count and rewritten in its original location. Images can be deleted from the display by decrementing each of the data words associated with the image.

Additional images or portions of images may be conveniently relocated using the increment/decrement logic 34. Functionally addresses identifying the storage locations corresponding to the data to be moved are supplied to the graphic display 10 from the computer 12 via the interface logic and address multiplexer 18. Control signals transmitted via the control line 28, display timing and control logic 26 and the display control bus 31 cause the data representing the image or portion of an image to be moved and stored at the specified addresses to be read and coupled to the increment and decrement circuit 34. Data words corresponding to the image or portion of an image at its original location are decremented one count and rewritten in the graphics display memory 20. Similarly data words corresponding to the image or portion of an image at its new location are incremented one count and rewritten in the graphics display memory 20. This permits overlapping images, or portions thereof, to be relocated with minimum intervention by the digital computer 12.

Figure 3:
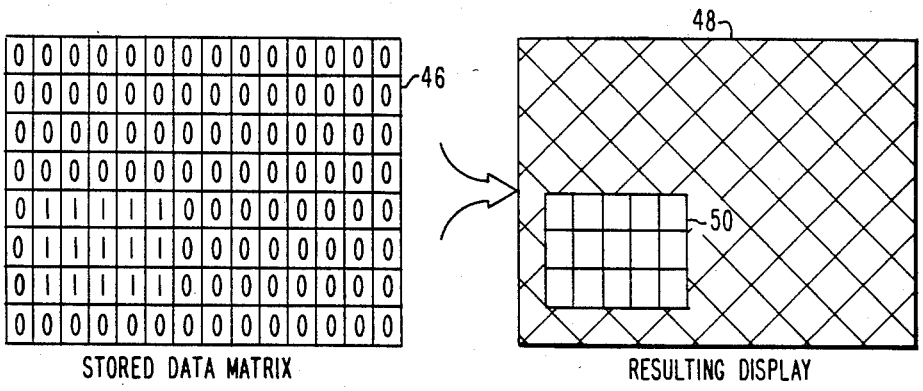
FIG. 3 is a diagram illustrating a first stored data matrix and the resulting display.

FIG. 3 further illustrates the operation of the data words for a single level of display. A rectangular segment of a typical display data memory is functionally illustrated at reference numeral 46 with each storage location represented as a square. In this illustration, the binary value of the data word stored in each location is indicated by a decimal number within the square. To produce an image, the illustrated data is sequentially read beginning with the top line to generate a raster-scan type display as illustrated at reference numeral 48. The memory locations having a binary value of zero result in the associated pixel of the display 48 being dark, indicated by cross hatching in FIG. 3. The memory locations having a binary "one" value stored therein result in associated pixels being illuminated, indicated by the checkerboard pattern 50 in FIG. 3.

Figure 4:
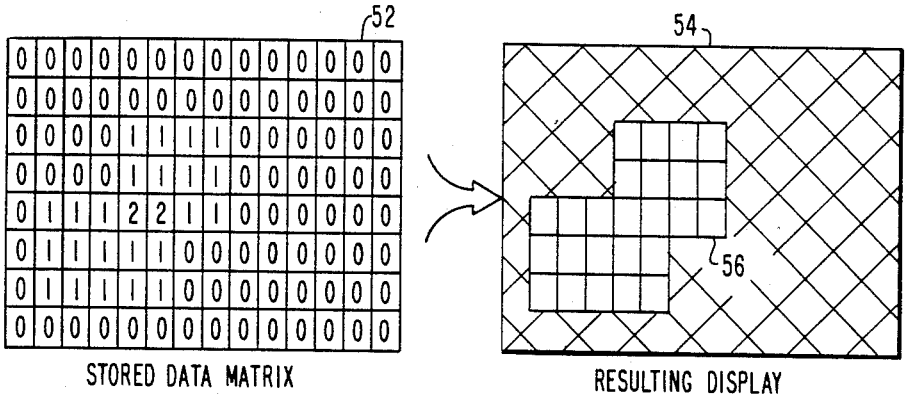
FIG. 4 is a diagram indicating a stored data matrix and the resulting display when two images overlap.

FIG. 4 is a similar drawing illustrating two images, a portion of which overlap. Data matrix is sequentially read from the memory segment 52 as described above. Each pixel associated with a storage location having a binary value of zero stored therein results in the associated pixels of the display being dark, as indicated by cross hatching. Matrix locations having non-zero binary values stored therein result in the associated pixels being illuminated, as indicated by the checkerboard pattern 56.

Figure 5:
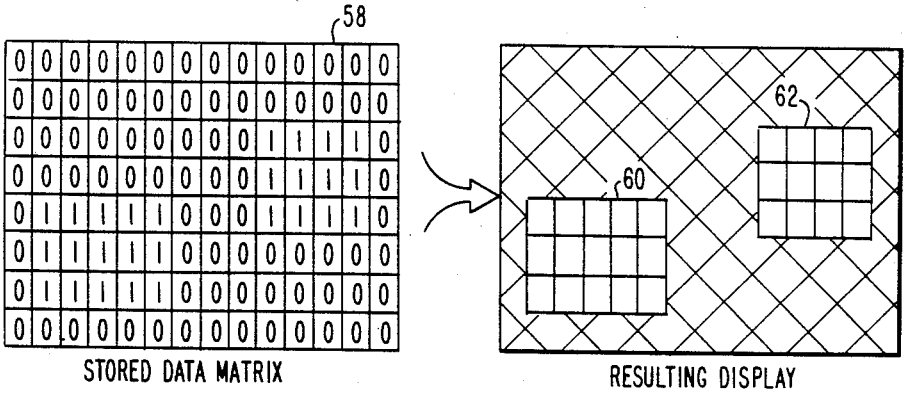
FIG. 5 is a stored data matrix and the resulting display illustrating the relocation overlapping images.

Relocation is a process whereby the elements of the image to be moved are erased and rewritten at the new location. (To erase a pixel the associated memory location is decremented one count. To write the memory location is incremented one count). Relocation of the two images including the overlapping portions is illustrated in FIG. 5. In the data matrix after relocation of the overlapping portions is illustrated at reference numeral 58 in FIG. 5. It should be noted that the storage locations corresponding to the overlapping portions of the memory have been decremented reducing their value from "two" to "one" and the remainder of the data words have been erased and rewritten at a new location. The two images after completion of the relocation process are respectively illustrated by the checkerboard patterns 60 and 62.

The display system described above is a single color raster scan display system without gray scale differentiation. That is to say, each pixel of the display was either dark (preferred background) or is illuminated to display an image. Of course, an illuminated background with the image displayed as darker areas can also be used.

Overlapping images in black and white displays having more than one gray scale can be similarly relocated. However, in such systems if two overlapping images have a different gray scale, there must of necessity be some error where they overlap.

Similar considerations apply to color display systems in which the final displayed image is composed of the three primary colors. If each pixel for each color is limited to a two-level signal (illuminated or background) the number of colors available in the final image is limited to equal combinations of the primary colors. Including the capability of utilizing video signals for each pixel which continuously vary (analog) between the background and fully illuminated values permit displayed images to cover the full color spectrum. Modifying the above system to include these features requires expanding each storage location by the graphics display memory 20 (FIG. 1) to provide sufficient storage for digital data specifying these conditions.

Figure 6:
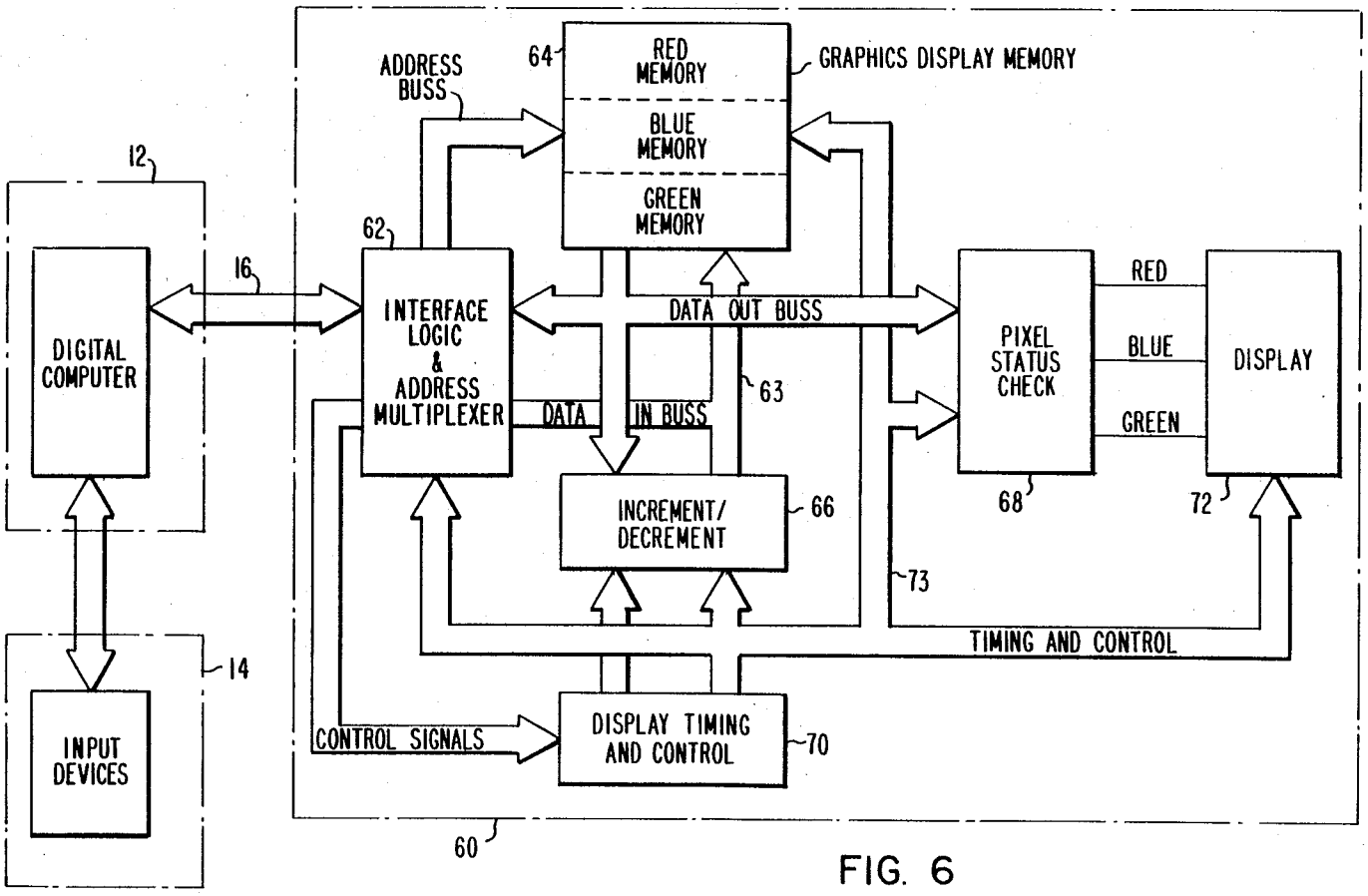
FIG. 6 is a block diagram of a second embodiment of the invention.

FIG. 6 is a diagram illustrating a modification of the basic display system to operate a color-type display system in which the displayed image is limited to equal combination of the primary colors. The system illustrated in FIG. 6 includes an input device 14 and a digital computer 12. Since these components are essentially identical with the similar components in FIG. 1 the same reference numerals are used to identify these components. The digital computer 12 is coupled to the color display system 60 via the interface bus 16 of the digital computer 12. Input bus 16 is coupled to an interface and address multiplexer logic 62 to generate addresses for the graphics display memory 64. A modified graphics display memory 64 includes three identical sections labeled red, blue, and green, corresponding to the primary colors. Each of these memories is essentially identical to the graphics display memory 20, illustrated in FIG. 1, in that each storage location of the memory include storage for a multi-bit digital word for each of the primary colors.

To update the data stored in the graphics display memory 64, the digital computer 12 communicates with the memory through the interface logic 62, and the data bus 63. Similarly, the display and timing control logic 70 communicates with the digital computer 12 via the control signal bus and the interface logic 62 and provides timing and control signals to the display data memory 64, the pixel status check 68 and the display and sweep circuits 72 via the timing and control bus 73. Images or portions of images are relocated by routing of the appropriate data words representing the three primary colors through the increment/decrement circuit 66. The increment/decrement circuit 66 can increment the red and blue and green sections independently. The pixel status check circuit 68 checks each of these independently and provides the red, blue and green display signals to the display and sweep circuits 72.

As previously discussed, the system can be modified to display images comprising colors other than equal combinations levels of the primary colors by providing sufficient memory to specify the magnitude of the color signals for each pixel.

I claim:

1. A graphic display system including means for non-destructive relocation of overlapping image elements; comprising in combination:

(a) a display screen divided into a matrix of display elements (pixels), during normal operation each of said display elements utilized to display the image having a first illumination state, all other display elements having a background illumination state;

(b) an addressable multiple storage location digital memory with each of said display elements being associated with a unique storage location, each of said storage locations providing sufficient storage for a multi-bit digital number; with a digital number stored at a location having a zero value specifying that the associated display element will have said background illumination state and a non-zero value specifying that the associated display element have said first illumination state, each unique non-zero value specifying a unique number of images intersecting at said associated display element;

(c) first control means for selectively reading stored digital numbers from said addressable multiple storage location digital memory to generate a raster scan display video signal;

(d) means for coupling said video signal to said display screens to display a selected image;

(e) second control means selectively changing the binary value of digital numbers stored in selected ones of said storage locations as the number of said intersecting images changes as the result of the relocation of a selected image.

2. A graphics display system including means for non-destructive relocation of image elements shared by a plurality of images, comprising:

(a) a display screen divided into a matrix of display elements (pixels), during normal operation each of said display elements being used to display an image having a first illumination state, all other display elements having a second illumination state;

(b) an addressable multiple storage location digital memory with each of said display elements being associated with a specific storage location, each of said storage locations providing storage capacity for a multi-bit digital number, a selected value of said stored digital number corresponding to said first illumination state, each additional unique binary value corresponding to said second illumination state and to a unique number of images intersecting at and sharing a display element associated with said storage location;

(c) first control means for selectively reading digital numbers from said digital memory to generate a raster scan video signal;

(d) means for coupling said video signal to said display screen to display a selected image;

(e) second control means for selectively changing the value of digital numbers stored in said digital memory to change the number of independent images associated with said digital number.

3. A graphic display system in accordance with claim 2 wherein a digital word having a value of zero stored at a specific location specifies that the associated pixel in the final display will have a background illumination state.

4. A graphic display system in accordance with claim 3 wherein a digital word having a non-zero value stored at a location in said digital memory specifies that the associated pixel in the final display will be illuminated to display a portion of an image.

5. A display system in accordance with claim 4 wherein said second control means decrements by one binary count all data words representing an image at its current location to delete an overlapping image and increments all data words representing said image at a selected location to relocate said image to said selected location under the control of a digital computer.

6. A graphics display system for displaying overlapping images with non-overlapping portions of said images displayed in selected colors, comprising:

(a) a display screen divided into a matrix of display elements (pixels), each of said display elements utilized to display the non-overlapping portions of said images having a selected illumination state and a selected color state, said color state comprising a combination of the primary colors, display elements utilized by overlapping images having a color state determined by the specified color of said overlapping images, all other display elements having a background illumination and a background color state;

(b) an addressable multiple storage location digital memory with each of said display elements being associated with a specific storage location, each storage location having sufficient storage capability to store a digital number specifying the illumination state, the number of overlapping images and the combination of primary colors of the associated display element with a selected binary values specifying a background illumination state and color, all other values specifying the combination of primary colors and illumination state of elements of an image to be displayed;

(c) first control means for selectively reading data from said digital memory to generate a video signal;

(d) means for coupling said video signal to said display screen to display a selected image;

(e) second control means for selectively changing said digital number stored in said digital memory to change said number of overlapping images.

* * * * *